US009188952B2

(12) United States Patent
Inui et al.

(10) Patent No.: US 9,188,952 B2
(45) Date of Patent: Nov. 17, 2015

(54) TONER COLLECTING DEVICE AND IMAGE FORMING APPARATUS INCLUDING THE SAME

(71) Applicant: KYOCERA DOCUMENT SOLUTIONS INC., Osaka (JP)

(72) Inventors: Hiroshi Inui, Osaka (JP); Mitsuhiro Goda, Osaka (JP); Koji Izumi, Osaka (JP); Naoki Mizutani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/227,997

(22) Filed: Mar. 27, 2014

(65) Prior Publication Data

US 2014/0294429 A1 Oct. 2, 2014

(30) Foreign Application Priority Data

Mar. 28, 2013 (JP) ..... 2013-069780
Mar. 28, 2013 (JP) ..... 2013-069781
Mar. 28, 2013 (JP) ..... 2013-069784

(51) Int. Cl.
*G03G 15/08* (2006.01)
*G03G 21/10* (2006.01)
*G03G 21/20* (2006.01)

(52) U.S. Cl.
CPC ..... *G03G 21/206* (2013.01); *G03G 15/0898* (2013.01); *G03G 21/105* (2013.01)

(58) Field of Classification Search
CPC G03G 15/0898; G03G 21/105; G03G 21/206
See application file for complete search history.

(56) References Cited

U.S. PATENT DOCUMENTS 4,295,734 A * 10/1981 Tsuda et al. ..... 399/355
8,554,104 B2 10/2013 Shimoyama et al.
8,660,458 B2 2/2014 Akiyama
2011/0103821 A1* 5/2011 Akiyama ..... 399/93
2011/0211860 A1 9/2011 Shimoyama et al.

FOREIGN PATENT DOCUMENTS

JP S59-160165 A 9/1984

(Continued)

OTHER PUBLICATIONS

An Office Action; "Notice of Reasons for Rejection," issued by the Japanese Patent Office on Jun. 23, 2015, which corresponds to Japanese Patent Application No. 2013-069780 and is related to U.S. Appl. No. 14/227,997.

(Continued)

*Primary Examiner* — Sandra Brase
(74) *Attorney, Agent, or Firm* — Studebaker & Brackett PC

(57) ABSTRACT

A toner collecting unit includes a housing, an inlet, a first fan, a lower duct, a first filter, and an oscillation motor. The inlet is provided in the housing. Toner flows into the inlet together with an air flow. The first fan is arranged in the interior of the housing and is configured to suck the air flow flowing from the inlet and to exhaust the air outside the housing. The lower duct guides the air flow upward from below. The first filter is arranged in an upper part of the lower duct so that its approach surface, which the air flow enters, faces downward.

18 Claims, 11 Drawing Sheets

(56) References Cited

FOREIGN PATENT DOCUMENTS

| | | | |
|---|---|---|---|
| JP | H03-012686 | A | 1/1991 |
| JP | H09-244410 | A | 9/1997 |
| JP | 2001-194967 | A | 7/2001 |
| JP | 2005-257768 | A | 9/2005 |
| JP | 2007-298782 | A | 11/2007 |
| JP | 2010-240577 | A | 10/2010 |
| JP | 2011-095646 | A | 5/2011 |
| JP | 2011-180236 | A | 9/2011 |
| JP | 2012-034758 | A | 2/2012 |
| JP | 2012-034759 | A | 2/2012 |

OTHER PUBLICATIONS

An Office Action; "Notice of Reasons for Rejection," issued by the Japanese Patent Office on Jul. 7, 2015, which corresponds to Japanese Patent Application No. 2013-069781 and is related to U.S. Appl. No. 14/227,997.

An Office Action; "Notice of Reasons for Rejection," issued by the Japanese Patent Office on Jul. 7, 2015, which corresponds to Japanese Patent Application No. 2013-069784 and is related to U.S. Appl. No. 14/227,997.

* cited by examiner

TONER COLLECTING DEVICE AND IMAGE FORMING APPARATUS INCLUDING THE SAME

INCORPORATION BY REFERENCE

The present application claims priority under 35 U.S.C. §119 to Japanese Patent Application Nos. 2013-069780, 2013-069781, and 2013-069784, filed Mar. 28, 2013. The contents of these applications are incorporated herein by reference in their entirety.

BACKGROUND

The present disclosure relates to a toner collecting device and an image forming apparatus including it.

Image forming apparatuses employing an electrographic method (e.g., copiers, printers, and facsimile machines) form a toner image on an image bearing member (e.g., photosensitive drum or transfer belt) in a manner that an electrostatic latent image formed on the image bearing member is developed by supplying toner to the electrostatic latent image. The toner is retained in a developing device and is supplied to the image bearing member from a development roller provided in the developing device.

Of the toner retained in the developing device, less charged toner is liable to fly around the developing device. The flying toner may contaminate the inside and outside of an apparatus main body of an image forming apparatus. For this reason, an image forming apparatus is examined on which a dust collecting device for collecting the flying toner is mounted. In this technique, in order to prevent a filter from clogging with the flying toner, an oscillation section to oscillate the filter is provided.

SUMMARY

A toner collecting device according to one mode of the present disclosure includes a housing, an inlet, a fan, a guide duct portion, a first filter, and an oscillation section. The inlet port is provided in the housing. Toner flows into the inlet together with an air flow. The fan is arranged in an interior of the housing and is configured to suck the air flow flowing from the inlet and to exhaust the air flow outside the housing. The guide duct portion is arranged between the inlet and the fan in a path of the air flow and is configured to guide the air flow upward from below. The filter is arranged upstream of the fan in the path of the air flow and in an upper part of the guide duct portion so that its approach surface, which the air flow enters, faces downward. The oscillation section is configured to oscillate the first filter.

An image forming apparatus according to another mode of the present disclosure includes an image bearing member configured to bear a toner image; a developing device configured to supply toner to the image bearing member; the above toner collecting device; and a collection duct configured to collect the toner together with an air flow in an interior of or around the developing device and to allow the toner to flow into the inlet.

DETAILED DESCRIPTION

Figure 1:
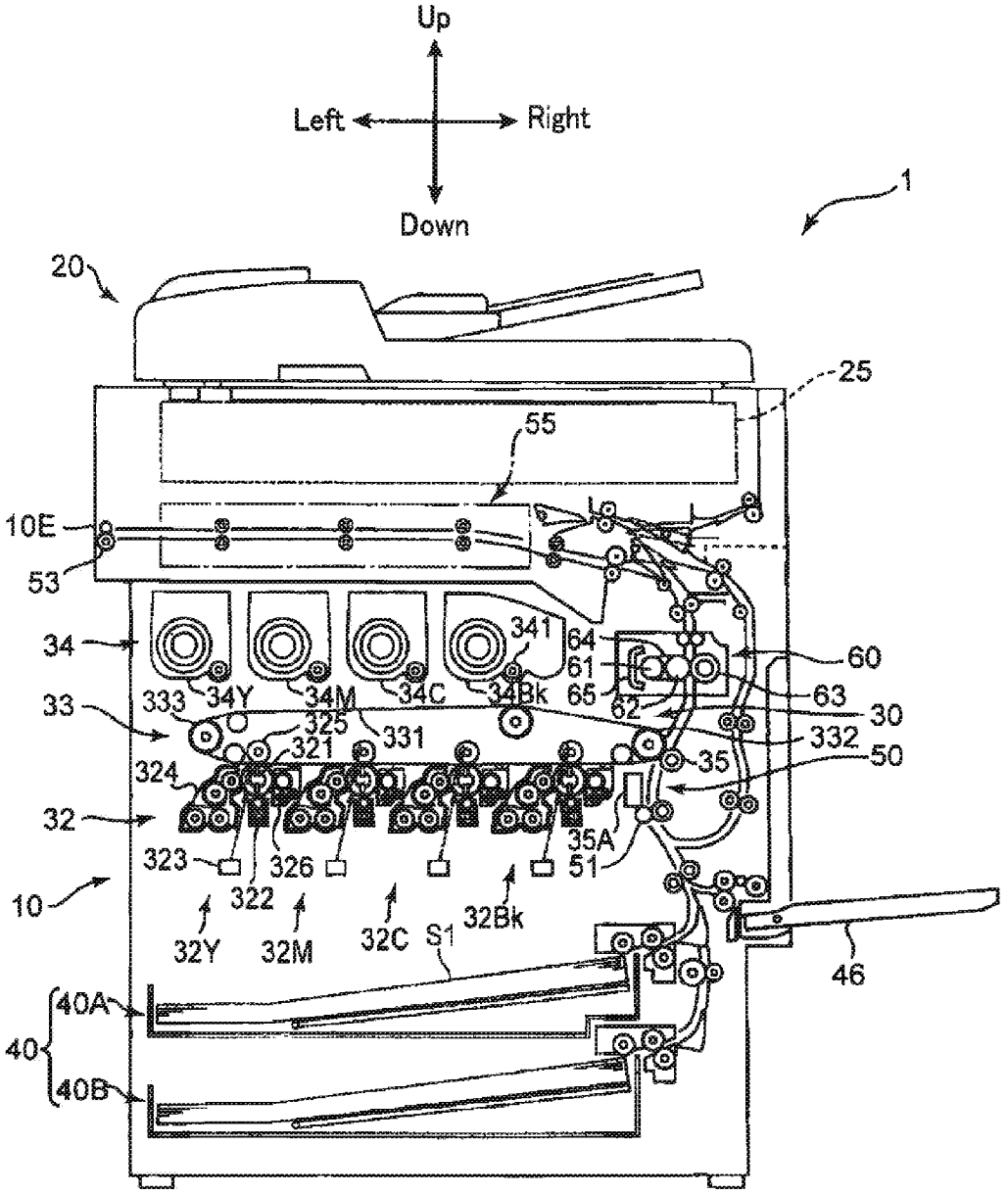
FIG. 1 is a schematic cross sectional view showing an internal configuration of an image forming apparatus according to one embodiment of the present disclosure.

Embodiments of the present disclosure will be described in detail below with reference to the accompanying drawings. FIG. 1 is a schematic cross sectional view showing an internal configuration of an image forming apparatus 1 according to one embodiment of the present disclosure. A multifunction peripheral having functions of a printer and a copier is exemplified as an image forming apparatus 1 herein. However, the image forming apparatus may be any one of a printer, a copier, and facsimile machine.

<Image Forming Apparatus>

The image forming apparatus 1 includes an apparatus main body 10 and an auto document feeder 20. The apparatus main body 10 has a casing configuration substantially in a rectangular parallelepiped shape. The auto document feeder 20 is arranged on the apparatus main body 10. In the interior of the apparatus main body 10, a reading unit 25, an image forming section 30, a fusing section 60, a paper feeder 40 (sheet accommodation section), a conveyance path 50, and a conveyance unit 55 are accommodated. The reading unit 25 optically reads a to-be-copied document image. The image forming section 30 forms a toner image on a sheet. The fusing section 60 fuses the toner image to the sheet. The paper feeder 40 (sheet accommodation section) stores a sheet to be conveyed to the image forming section 30. In the conveyance path 50, a sheet is conveyed from the paper feeder 40 or a paper feed tray 46 to a sheet exit port 10E via the image forming section 30 and the fusing section 60. The conveyance unit 55 includes in its interior a sheet conveyance path that forms a part of the conveyance path 50.

The image forming section 30 forms a toner image on a sheet. Specifically, the image forming section 30 generates a full color toner image and transfers the generated toner image to a sheet. The image forming section 30 includes an image forming unit 32, an intermediate transfer unit 33, and a toner replenishing section 34. The image forming unit 32 includes four units 32Y, 32M, 32C, and 32Bk which are arranged in tandem and form yellow (Y), magenta (M), cyan (C), and black (Bk) toner images, respectively. The intermediate transfer unit 33 is arranged on the image forming unit 32 in an adjacent fashion. The toner replenishing section 34 is arranged above the intermediate transfer unit 33.

Each of the image forming units 32Y, 32M, 32C, and 32Bk includes a photosensitive drum 321 (image bearing member), a charger 322, an exposure unit 323, a developing device 324, a primary transfer roller 325, and a cleaner 326. The charger 322, the exposure unit 323, the developing device 324, the primary transfer roller 325, and the cleaner 326 are arranged around the corresponding photosensitive drum 321.

The photosensitive drum 321 rotates about its axis and bears an electrostatic latent image and a toner image on its peripheral surface. One example of the photosensitive drum 321 may be a photosensitive drum made from an amorphous silicon (a-Si) based material. The charger 322 charges the surface of the photosensitive drum 321 uniformly. The exposure unit 323 includes a laser light source and optical systems (mirror, lens, etc.), and forms an electrostatic latent image in a manner that light based on image data of a document image is irradiated to the peripheral surface of the photosensitive drum 321 for exposure. The photosensitive drum 321 functions as an image bearing member.

The developing device 324 supplies toner to the peripheral surface of the photosensitive drum 321 for development of an electrostatic latent image formed on the photosensitive drum 321. In one example, the developing device 324 may be a developing device for a two-component developer. The developing device 324 includes a screw feeder, a magnetic roller, and a development roller. As shown in FIG. 1, the developing devices 324 for the respective colors are arranged side by side in the horizontal direction (right and left directions).

The primary transfer roller 325 nips an intermediate transfer belt 331, which is provided in the intermediate transfer unit 33, together with each photosensitive drum 321 to form a nip part, so that toner images on the photosensitive drums 321 are primarily transferred to the intermediate transfer belt 331. The cleaner 326 includes a cleaning roller and the like to clean the peripheral surface of the corresponding photosensitive drum 321 after transfer of a toner image.

The intermediate transfer unit 33 includes the intermediate transfer belt 331, a drive roller 332, and a driven roller 333. The intermediate transfer belt 331 is wound between the drive roller 332 and the driven roller 333. Toner images are transferred from the respective photosensitive drums 321 so as to be overlaid with each other at the same location on the outer peripheral surface of the intermediate transfer belt 331. The intermediate transfer belt 331 is rotated in the anticlockwise direction in FIG. 1. The intermediate transfer belt 331 functions as an image bearing member.

A secondary transfer roller 35 (transfer section) is arranged to face the peripheral surface of the drive roller r 332. The secondary transfer roller 35 transfers toner images from the intermediate transfer belt 331 to a sheet. A nip part between the drive roller drive 332 and the secondary transfer roller 35 serves as a secondary transfer section for transfer of a full color toner image, which is toner mages overlaid on the intermediate transfer belt 331, to a sheet. A secondary transfer bias potential having a polarity opposite to that of the toner image is applied to either one of the drive roller 332 and the secondary transfer roller 35, while the other roller is grounded. Further, a density sensor 35A is arranged to face the peripheral surface of the intermediate transfer belt 331 on the upstream side of the drive roller 332 in the rotation direction of the intermediate transfer belt 331. The density sensor 35A outputs electric signals according to the density of an image formed on the intermediate transfer belt 331.

The toner replenishing section 34 includes a yellow toner container 34Y, a magenta toner container 34M, a cyan toner container 34C, and a black toner container 34Bk. The toner containers 34Y, 34M, 34C, and 34Bk store toner in the respective colors. The toner containers 34Y, 34M, 34C, and 34Bk supply the corresponding color toner through supply paths (not shown) to the developing devices 324 of the image forming units 32Y, 32M, 32C, and 32Bk for the respective colors of Y, M, C, and Bk.

The paper feeder 40 includes two paper feed cassettes 40A and 40B to accommodate sheets on which image formation is to be performed. The paper feed cassettes 40A and 40B are capable of being drawn out frontward from the front of the apparatus main body 10. The paper feeder 40 accommodates sheets to be conveyed to the secondary transfer roller 35. The paper feeder 40 is arranged below the aforementioned developing devices 324.

Herein, the fusing section 60 is of induction heating type for fusion to fuse a toner image to a sheet. The fusing section 60 includes a heating roller 61, a fusing roller 62, a pressure roller 63, a fusing belt 64, and an induction heating unit 65. The pressure roller 63 is in press contact with the fusing roller 62 to form a fusing nip part. The induction heating unit 65 induction heats the heating roller 61 and the fusing belt 64 so that the heat is applied to the fusing nip part. When a sheet passes through the fusing nip part, the toner image transferred to the sheet is fused to the sheet.

Figure 2:
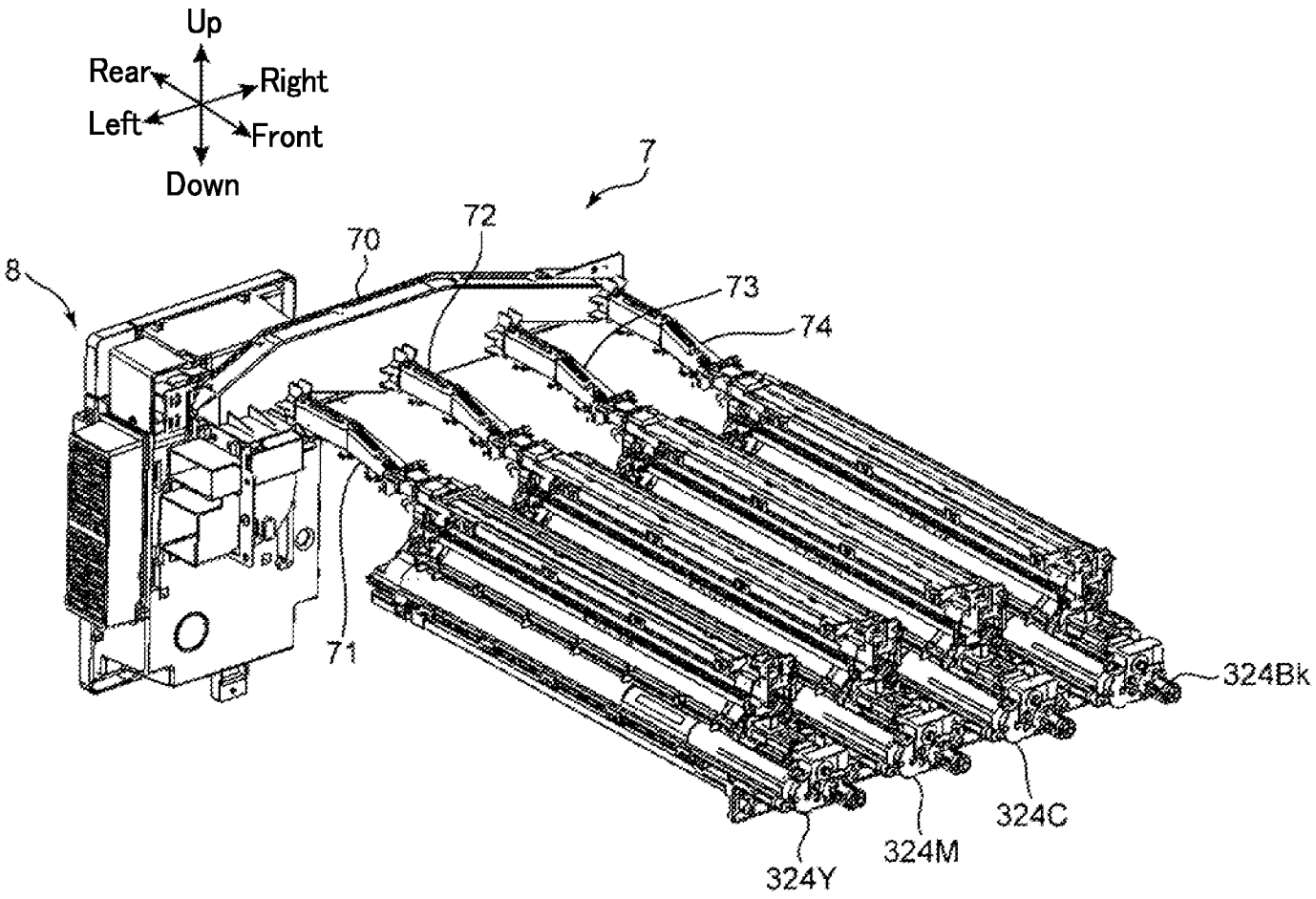
FIG. 2 is a perspective view of a developing device and a toner collecting device in the image forming apparatus according to one embodiment of the present disclosure.
Figure 3:
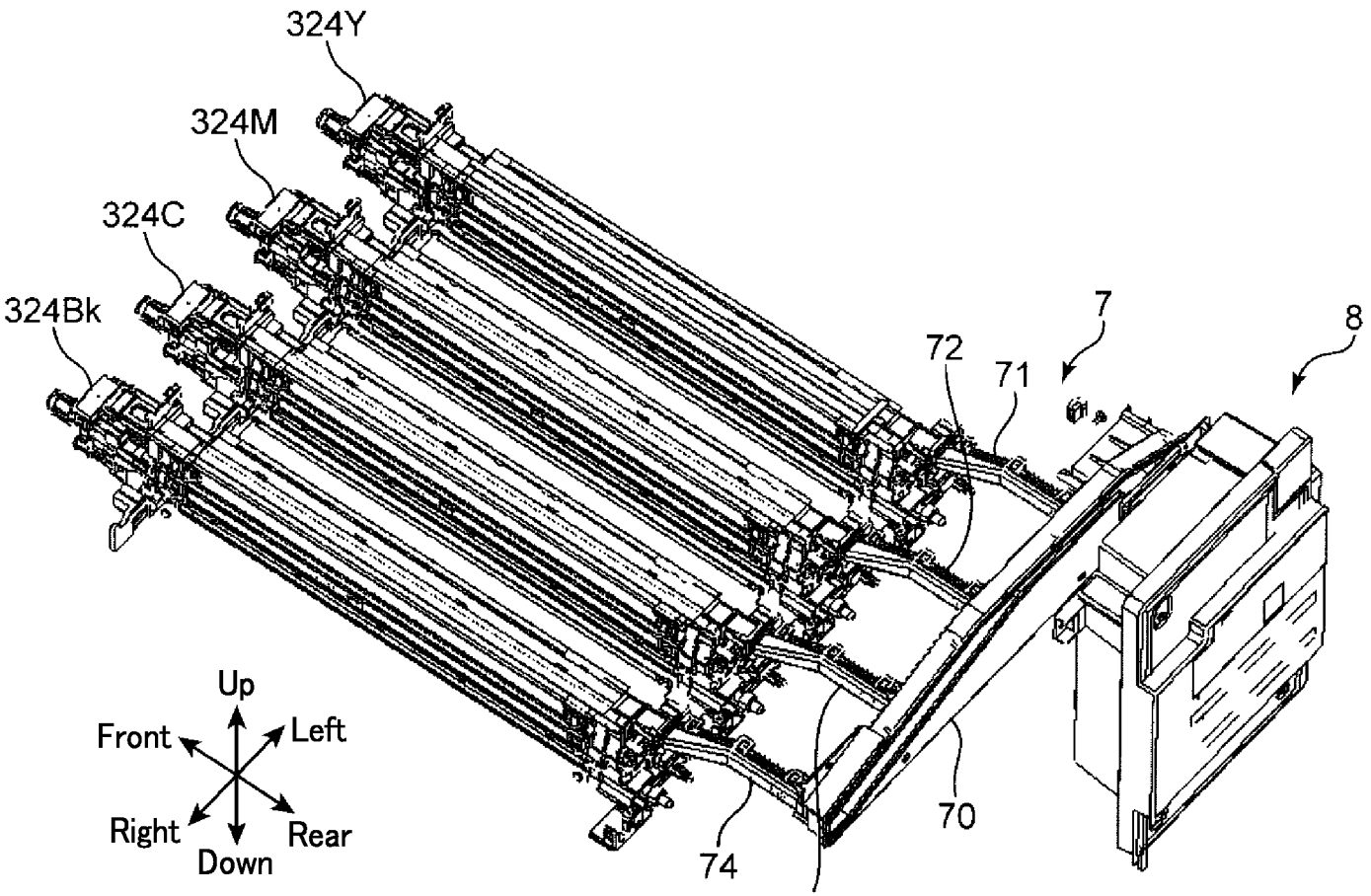
FIG. 3 is a perspective view of the developing device and the toner collecting device in the image forming apparatus according to one embodiment of the present disclosure.
Figure 4:
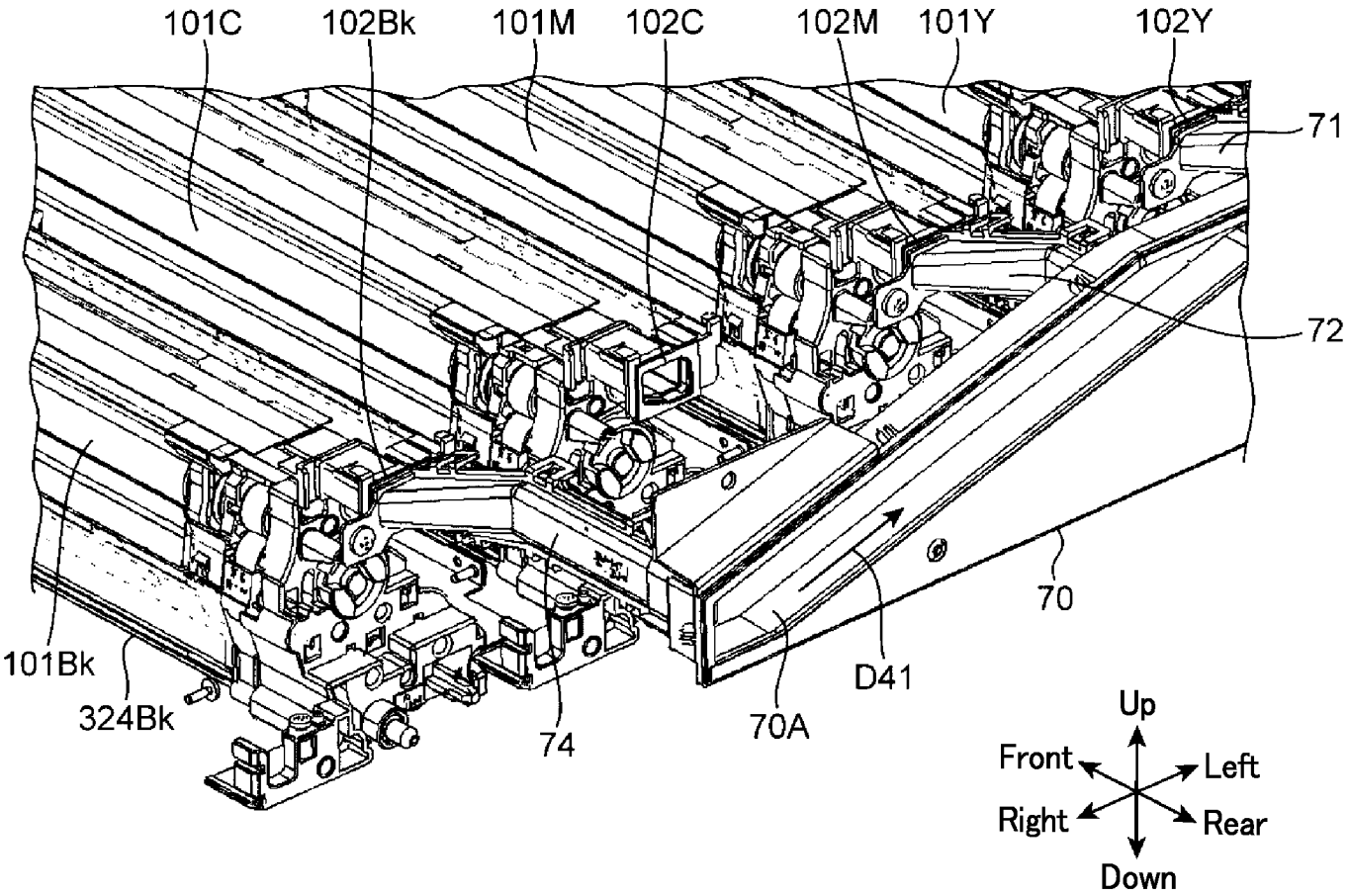
FIG. 4 is an enlarged perspective view of the developing device and a collection duct in the image forming apparatus according to one embodiment of the present disclosure.

The image forming apparatus 1 further includes a collection duct 7 and a toner collecting unit (toner collecting device) 8. FIGS. 2 and 3 are perspective views of the developing devices 324, the collection duct 7, and the toner collecting unit 8 according to the present embodiment. FIG. 4 is an enlarged perspective view of the developing devices 324 and the collection duct 7 when viewed from the back according to the present embodiment.

FIGS. 2 and 3 are referred to herein. The collection duct 7 is arranged at the rear of the adjacently arranged developing devices 324 (324Y, 324M, 324C, and 324Bk) for the respective colors. The collection duct 7 collects toner together with an air flow from the interior of each developing device 324 and allows them to flow into an inlet 800 (see FIG. 5) of the toner collecting unit 8. As shown in FIG. 2, the collection duct 7 conveys the toner substantially horizontally from each developing device 324. It is noted that in another embodiment, the collection duct 7 may be a duct to collect toner flying around each developing device 324. The collection duct 7 includes a main duct 70, a yellow duct 71, a magenta duct 72, a cyan duct 73, and a black duct 74. The main duct 70 is a duct extending in the right and left directions at the rear of the developing devices 324. A plurality of exhaust paths, to which toner collected from the respective developing devices 324 for the respective colors is conveyed, are arranged in parallel to each other in the interior of the main duct 70 (see exhaust path 70A for black color in FIG. 4). The yellow duct 71, the magenta duct 72, the cyan duct 73, and the black duct 74 allow the toner collected from the interior of the respective developing devices 324 for the respective colors to flow into the respective exhaust paths of the main duct 70.

FIG. 4 is referred to herein. The developing device 324 (324Y, 324M, 324C, and 324Bk) for each color includes a development roller 101 (101Y, 101M, 101C, and 101Bk). The development roller 101 bears a toner on its peripheral surface and supplies toner to the corresponding photosensitive drum

321. Further, a screw (not shown) to stir toner and supply the toner to the corresponding development roller 101 is provided in the interior of the developing device 324 for each color. The developing device 324 for each color includes an exit port 102 (102Y, 102M, 102C, and 102Bk). The exit port 102 communicates with the interior of the corresponding developing device 324 and opens rearward from the developing device 324. For the sake of easy understanding of the configuration, the cyan duct 73 is omitted in FIG. 4 to expose the exit port 102C for the cyan color. To the exit ports 102 for the respective colors, the yellow duct 71, the magenta duct 72, the cyan duct 73, and the black duct 74 are connected so that air flow including flying toner is conveyed from each developing device 324 to the main duct 70. As described above, the plurality of exhaust paths are arranged in parallel to each other in the interior of the main duct 70. In FIG. 4, the exhaust path 70A for the black color is shown. The exhaust paths for the other colors are arranged similarly in the interior of the main duct 70. The air flow flowing in the exhaust air path 70A for the black color through the duct 74 for the black color is lead to the left end part of the main duct, as indicated by the arrow D41 in FIG. 4.

The toner collecting unit 8 is connected to the left end part of the main duct 70. The toner collecting unit 8 is arranged at a lower level than the main duct 70.

<Configuration of Toner Collecting Unit 8>

Figure 5:
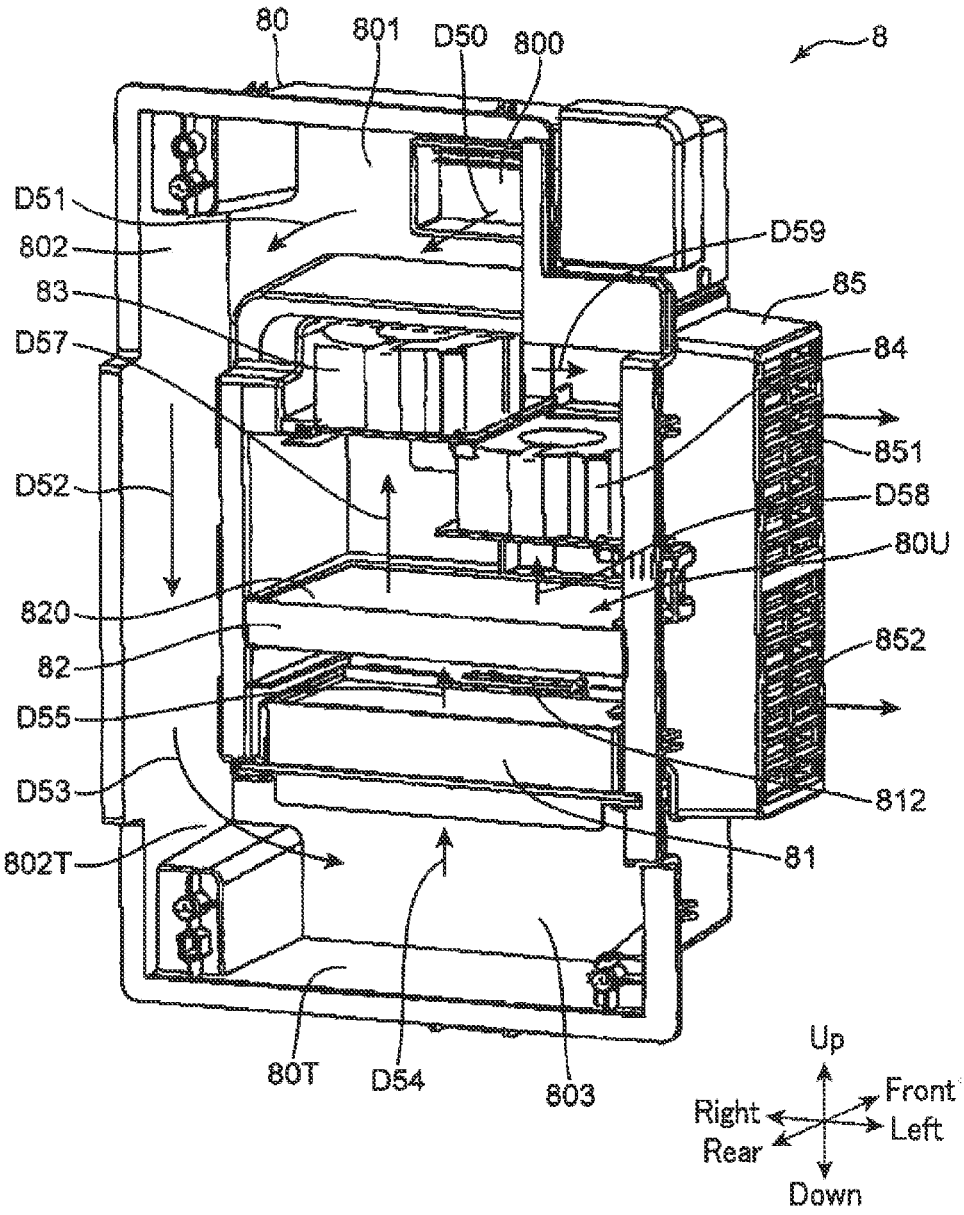
FIG. 5 is a perspective view of the interior of a toner collecting unit (toner collecting device) according to one embodiment of the present disclosure.
Figure 6:
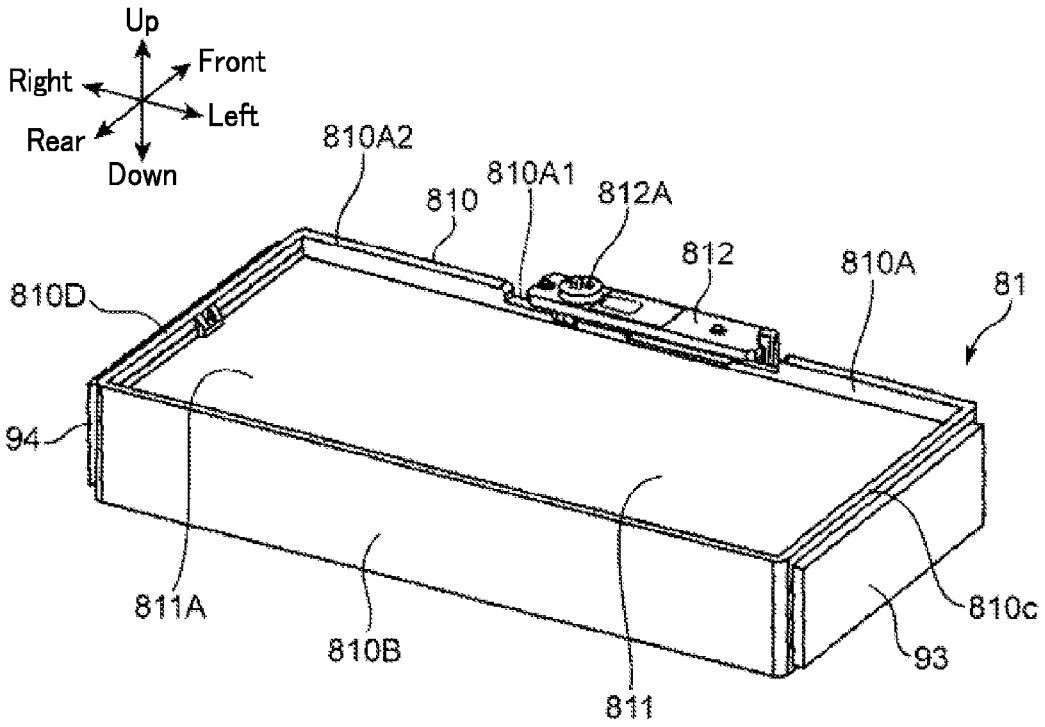
FIG. 6 is a perspective view of a first filter in the toner collection device according to one embodiment of the present disclosure.

With reference to FIGS. 5 and 6, the configuration of the toner collecting unit 8 according to the present embodiment will be described next. FIG. 5 is a perspective view of the interior of the toner collecting unit 8 according to the present embodiment. FIG. 6 is a perspective view of a first filter section 81 according to the present embodiment.

As shown in FIG. 5, the toner collecting unit 8 includes a housing 80, a first filter section 81, a second filter section 82, a first fan 83 (*fan*), a second fan 84 (*fan*), and an air exhausting section 85.

The housing 80 is substantially in a rectangular parallelepiped shape. The housing 80 communicates with the developing devices 324 of the image forming section 30 through the collection duct 7. The housing 80 defines the outer appearance of the toner collecting unit 8 and accommodates in its interior the first filter section 81, the second filter section 82, the first fan 83, and the second fan 84. Further, a plurality of duct portions to which an air flow is guided are provided in the interior of the housing 80. The housing 80 includes an inlet 800, an upper duct 801, a descending duct portion 802 (downward duct portion), an ascending duct portion 80U (upward duct portion), and a bottom portion 80T (reservoir). The bottom portion 80T serves as the bottom of the housing 80 and defines the bottom surface of the lower duct 803, which will be described later.

The inlet 800 opens in the housing 80. The inlet 800 communicates with the image forming section 30. The toner flows into the inlet 800 together with the air flow. The inlet 800 is provided at the upper end part of the housing 80. The plurality of exhaust air paths of the main duct 70 are merged immediately before the inlet 800 and continue to the inlet 800.

The upper duct 801 is a space in the upper end part of the housing 80. The upper duct 801 is arranged to face the inlet 800. Further, the upper duct 801 communicates with the descending duct portion 802.

Further, the descending duct portion 802 communicates with the right end part of the upper duct 801. In other words, the descending duct portion 802 is arranged to communicate with the inlet 800 through the upper duct 801 in the interior of the housing 80. The descending duct portion 802 guides the air flow downward to the bottom portion 80T of the housing 80. The descending duct portion 802 serves as a duct portion extending in the vertical direction in the right end part of the housing 80.

The ascending duct portion 80U is arranged horizontally and adjacently to the descending duct portion 802 in the interior of the housing 80. The ascending duct portion 80U communicates with the descending duct portion 802 through the bottom portion 80T to guide the air flow upward. The ascending duct portion 80U extends in the vertical direction from the bottom portion 80T to the region where the first fan 83 is arranged. The ascending duct portion 80U includes a lower duct 803 (guide duct portion). The lower duct 803 is arranged between the inlet 800 and the first and second fans 83 and 84 in the path of the air flow to guide the air flow upward from below. The lower duct 803 is arranged at the lower part of the ascending duct portion 80U. Further, as described above, the bottom portion 80T defines the bottom surface of the lower duct 803.

The descending duct portion 802 communicates with the lower duct 803 of the ascending duct portion 80U through an introduction portion 802T. In other words, the introduction portion 802T allows the air flow flowing from the inlet 800 to flow into the lower duct 803 from one side (right side) of the lower duct 803. The bottom portion 80T is arranged at the lower duct 803 located at a lower level than the introduction portion 802T.

The first filter section 81 is arrange on the upstream side of the first fan 83 and the second fan 84 in the path of the air flow and in the upper part of the lower duct 803 so that its approach surface, which the air flow enters, faces downward. The first filter section 81 catches toner flowing from the inlet 800 together with the air flow and allow the air flow to pass therethrough. The first filter section 81 is arranged at the lower part of the ascending duct portion 80U. The first filter section 81 is in a rectangular parallelepiped shape with a predetermined width in the vertical direction.

The second filter section 82 is arranged between the first and second fans 83 and 84 and the first filter section 81 in the path of the air flow. The second filter section 82 catches toner that the first filter section 81 cannot have caught and allows the air flow to pass therethrough. The second filter section 82 is in a rectangular parallelepiped shape with a predetermined width in the vertical direction.

The first and second fans 83 and 84 are arranged in the interior of the housing 80 to suck the air flow flowing from the inlet 800 and to exhaust the air outside the housing 80. The first and second fans 83 and 84 exhaust the air flow leftward from below. The first and second fans 83 and 84 are arranged at the upper part of the ascending duct portion 80U. As shown in FIG. 5, the first and second fan 83 and 84 are arranged above the second filter section 82 with predetermined intervals apart therefrom. The first fan 83 is arranged on the right in the upper end part of the ascending duct portion 80U. By contrast, the second fan 84 is arranged at the location on the left side of the ascending duct portion 80U which is displaced downward from the first fan 83 in the vertical direction. As such, in the present embodiment, a plurality of fans are arranged at the upper part of the ascending duct portion 80U. Further, the first and second fans 83 and 84 are arranged so as not to overlap with each other in the vertical direction, so that exhaust paths of the air flow exhausted from the first and second fans 83 and 84 are prevented from overlapping with each other. In other words, the arrangement of the first and second fans 83 and 84 can result in distribution of the air flow in the vertical direction, thereby efficiently exhausting the air flow leftward.

The air exhausting section 85 communicates with the ascending duct portion 80U on the downstream side of the first and second fans 83 and 84 in the path of the air flow. The air exhausting section 85 guides the air flow in the horizontal direction (leftward) and exhausts it outside the housing 80. As shown in FIG. 5, the air exhausting section 85 is arranged in the region of the left side surface of the housing 80 which ranges from the first filter section 81 to the first fan 83.

The air exhausting section 85 includes an upper exhaust filter 851 and a lower exhaust filter 852 (third filter). The upper exhaust filter 851 and the lower exhaust filter 852 are arranged on the downstream side of the first and second fans 83 and 84 in the path of the air flow to allow the air flow to pass therethrough. The upper exhaust filter 851 is arranged to face the first and second fans 83 and 84 in the horizontal direction. The lower exhaust filter 852 is arranged below the upper exhaust filter 851. The air flow exhausted from the first and second fans 83 and 84 is distributed in the vertical direction in the interior of the air exhausting section 85, passes through the upper and lower exhaust filters 851 and 852, and then is exhausted outside the housing 80.

As shown in FIG. 6, the aforementioned first filter section 81 includes a frame 810 (frame body), the first filter 811, and the oscillation motor 812 (oscillation section). The frame 810 is supported to the housing 80 and accommodates the first filter 811. The frame 810 is arranged to surround the four vertical surfaces (four side surfaces orthogonal to the approach surface) of the first filter 811. Any known fine particle filter may be employed as the first filter 811. The first filter 811 in the present embodiment includes filter paper (not shown) with a predetermined density. The filter paper is made from glass fiber with a diameter of 1 to 10 μm. The filling rate of the glass fiber is about 10%. The space between fibers is set between 10 and 50 μm. The oscillation motor 812 is fixed at the upper edge of the front wall of the frame 810 and oscillates the first filter 811 through the frame 810. The oscillation unit 812 includes an oscillation section 812A. The oscillation section 812A includes an eccentrically arranged anchor on a shaft extending from a motor (not shown). Rotation of the anchor generates oscillation from the oscillation section 812A.

The first filter 811 is in a rectangular parallelepiped shape having six surfaces as peripheral surfaces including an approach surface (not shown) which the air flow enters and an exhaust surface 811A from which the air flow is exhausted on the opposite side to the approach surface. The first filter 811 is arranged in the upper part of the lower duct 803 so that the approach surface faces downward.

The frame 810 has edges (upper and lower edges of the frame 810) parallel to the approach surface and the exhaust surface 811A of the first filter 811 and includes walls surrounding four surfaces of the six surfaces of the first filter 811, which intersect with the approach surface (and exhaust surface 811A). Specifically, the frame 810 includes a front frame portion 810A, a rear frame portion 810B, a left frame portion 810C, and a right frame portion 810D, each of which is the wall. The front frame portion 810A covers the front surface of the first filter 811. The rear frame portion 810B covers the rear surface of the first filter 811. The left frame portion 810C covers the left surface of the first filter 811. The right frame portion 810D covers the right surface of the first filter 811. The aforementioned oscillation unit 812 is disposed on a fixed edge 810A1 (edge) at the upper part of the front frame portion 810A.

Similarly to the first filter section 81, the second filter section 82 is formed in a manner that the second filter 820 (see FIG. 5) is arranged in a frame (not shown). Further, each of the second filter 820, the upper exhaust filter 851, and the lower exhaust filter 852 is a fine particle filter similar to the first filter 811.

A flow of the air flow and the toner in the toner collecting unit 8 will be described next. When the power source of the image forming apparatus 1 is turned on, and a controller 95, which will be described later, causes an image forming operation to rotate the development rollers 101 and screws (not shown) of the developing devices 324, a drive controller 96, which will be described later, causes the first fan 83 and the second fan 84 to rotate. This results in that the air flow including the toner flows into the toner collecting unit 8 from the developing devices 324 through the collection duct 7. The air flow (see arrow D50 in FIG. 5) flowing in the housing 80 from the inlet 800 flows into the descending duct portion 802 from the upper duct 801 (arrow D51). The air flow once falls down in the descending duct portion 802 (arrow D52) and flows then into the lower duct 803 from the side part of the lower duct 803 through the introduction portion 802T (arrow D53). The lower duct 803 guides the air flow upward from below (arrow D54). Subsequently, when the air flow passes through the first filter 811 of the first filter section 81 arranged in the upper part of the lower duct 803, the first filter 811 catches the toner. Further, the air flow (arrow D55) having passed through the first filter 811 passes through the second filter 820 of the second filter section 82. In this time, the second filter 820 catches toner not having caught by the first filter 811.

The air flow (arrows D57 and D58) having passed through the second filter 820 of the second filter section 82 flows into the first or second fan 83 or 84 on the left or right in the ascending duct portion 80U. Then, the air flow (arrow D59) is blown out leftward by the first and second fans 83 and 84. Subsequently, the air flow flows into the air exhausting section 85, passes through the upper or lower exhaust filter 851 or 852, thereby being exhausted outside the housing 80.

As described above, in the present embodiment, the first filter section 81 arranged upstream of the first and second fans 83 and 84 catches the toner flowing into the housing 80 together with the air flow. Further, the second filter section 82 is arranged upstream of the first and second fans 83 and 84 in the air flow path, and the upper and lower exhaust filters 851 and 852 are arranged downstream of the first and second fans 83 and 84. Accordingly, the toner can be collected reliably, thereby further preventing the toner from being exhausted outside the housing 80. Thus, contamination by flying toner can be favorably prevented inside and outside the image forming apparatus 1. It is noted that it is preferable to satisfy the relationship, $A2 \geq A1 \geq A3$ where A1 is a flowing rate of the air flow in the first filter 811 of the first filter section 81, A2 is a flowing rate thereof in the second filter 820 of the second filer portion 82, and A3 is a flowing rate thereof in the upper and lower exhaust filters 851 and 852. In this case, the air flow toward the first and second fans 83 and 84 can be formed reliably, and the toner can be favorably caught in first and second filters 811 and 820 on the upstream side. In particular, satisfaction of the relationship can set the flowing rate A3 of the upper and lower exhaust filters 851 and 852 arranged the most downstream in the air flow path to be the smallest. This can reliably allow the air to be exhausted outward of the upper and lower exhaust filter 851 and 852. Accordingly, the air can hardly stay between the first and second fans 83 and 84 and the upper and lower exhaust filters 851 and 852. Moreover, the air flow flowing from the inlet 800 can stably pass through the first and second filters 811 and 820. At that time, the first and second filters 811 and 820 can favorably catch the toner.

With the use of the toner collecting unit 8, much toner can be caught by the first filter 811 of the first filter section 81 arranged the most upstream in the path of the air flow. Clogging of the first filter 811 may impair the ability of toner collection. For this reason, in the present embodiment, the drive controller 96, which will be described later, drives the oscillation motor 812 with timing when the first and second fans 83 and 84 are not rotated. The oscillation motor 812 is driven to oscillate the first filter 811 through the frame 810 (FIG. 6). Accordingly, toner adhering especially to the lower surface of the first filter 811 falls down by the oscillation. In this manner, the oscillation of the frame 810 enables reliable transmission of the oscillation to the first filter 811 in the present embodiment. It is noted that the oscillation unit 812 is disposed on the fixed edge 810A1 as the upper edge of the frame 810. Accordingly, vertical oscillation can be stably transmitted to the first filter 811. This can promote toner falling from the first filter 811.

Furthermore, the first filter 811 is arranged so that its approach surface, which the air flow enters, faces downward. This can prevent falling toner from adhering again to the first filter 811. Accordingly, the first filter 811 can be prevented from being clogged as far as possible, and the toner can be collected stably. Further, as described above, the introduction portion 802T allows the air flow flowing from the inlet 800 to flow into the lower duct 803 from the side part of the lower duct 803. Then, the toner falling from the first filter 811 by oscillation of the oscillation motor 812 is retained in the bottom portion 80T. The bottom portion 80T is arranged in a portion of the lower duct 803 which is located at a lower level than the introduction portion 802T. Accordingly, it can be prevented that the toner retained in the bottom portion 80T disturbs air flow toward the lower duct 803.

Additional description will be made about the toner collection unit 8 of the image forming apparatus 1. As can be understood from the above description with reference to FIGS. 1, 2, and 5, the descending duct portion 802 and the ascending duct portion 80U of the housing 80 are arranged side by side in the horizontal direction in the interior of the housing 80. The air flow flowing from the inlet 800 once falls down in the descending duct portion 802 and then rises up in the ascending duct portion 80U. Accordingly, the air flow can become a rising air current reliably. Furthermore, the descending duct portion 802 and the ascending duct portion 80U are arranged side by side in the interior of the housing 80, thereby achieving space saving of the housing 80.

Yet further, the paper feeder 40 of the image forming apparatus 1 is arranged under the developing devices 324. The inlet 800 of the toner collecting unit 8 is formed at substantially the same height in the perpendicular direction as the developing devices 324. Further, the descending duct portion 802 and the ascending duct portion 80U of the toner collection unit 8 face the paper feeder 40 in the horizontal direction. Accordingly, the air flow flowing from the inlet 800 can become a rising air current reliably in the rear of the developing device 324 with the use of the height of the paper feeder 40 of the image forming apparatus 1.

Figure 7:
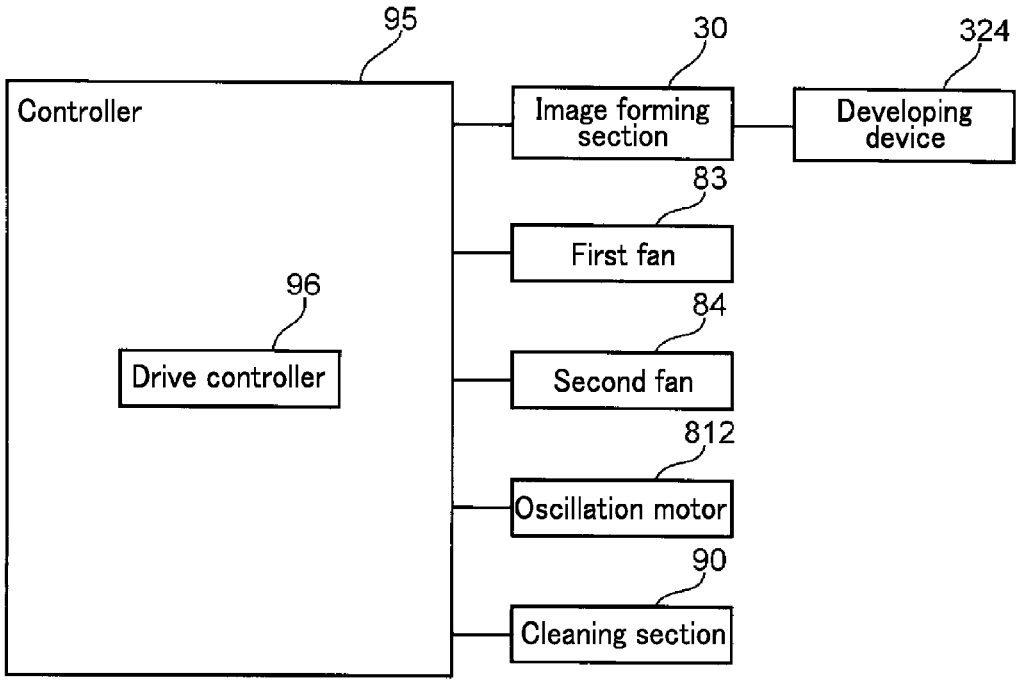
FIG. 7 is an electrical block diagram of the image forming apparatus according to one embodiment of the present disclosure.
Figure 8:
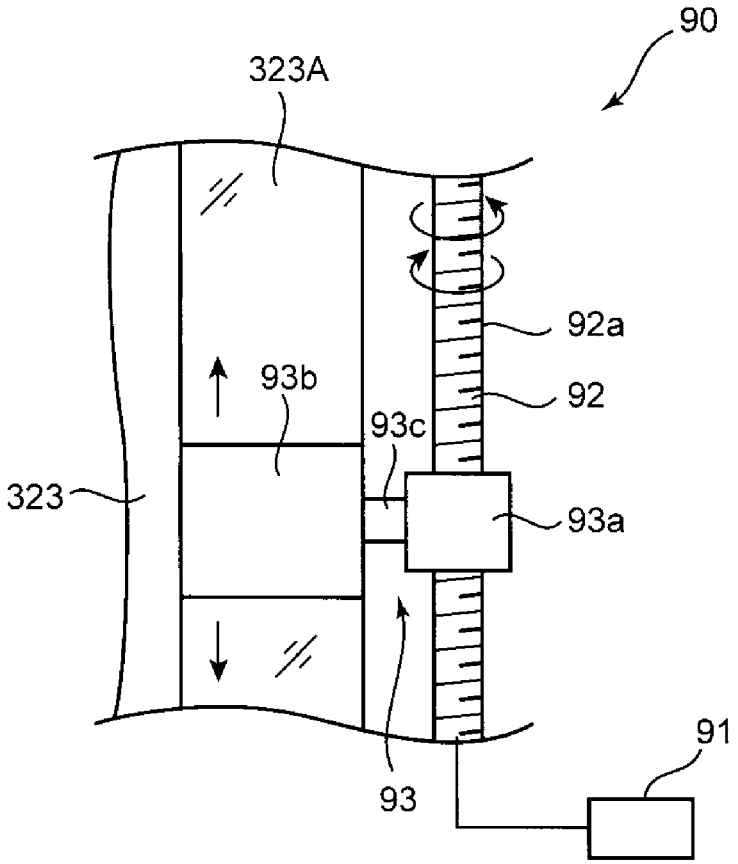
FIG. 8 is a schematic view of a cleaning section of an exposure device in the image forming apparatus according to one embodiment of the present disclosure.
Figure 9:
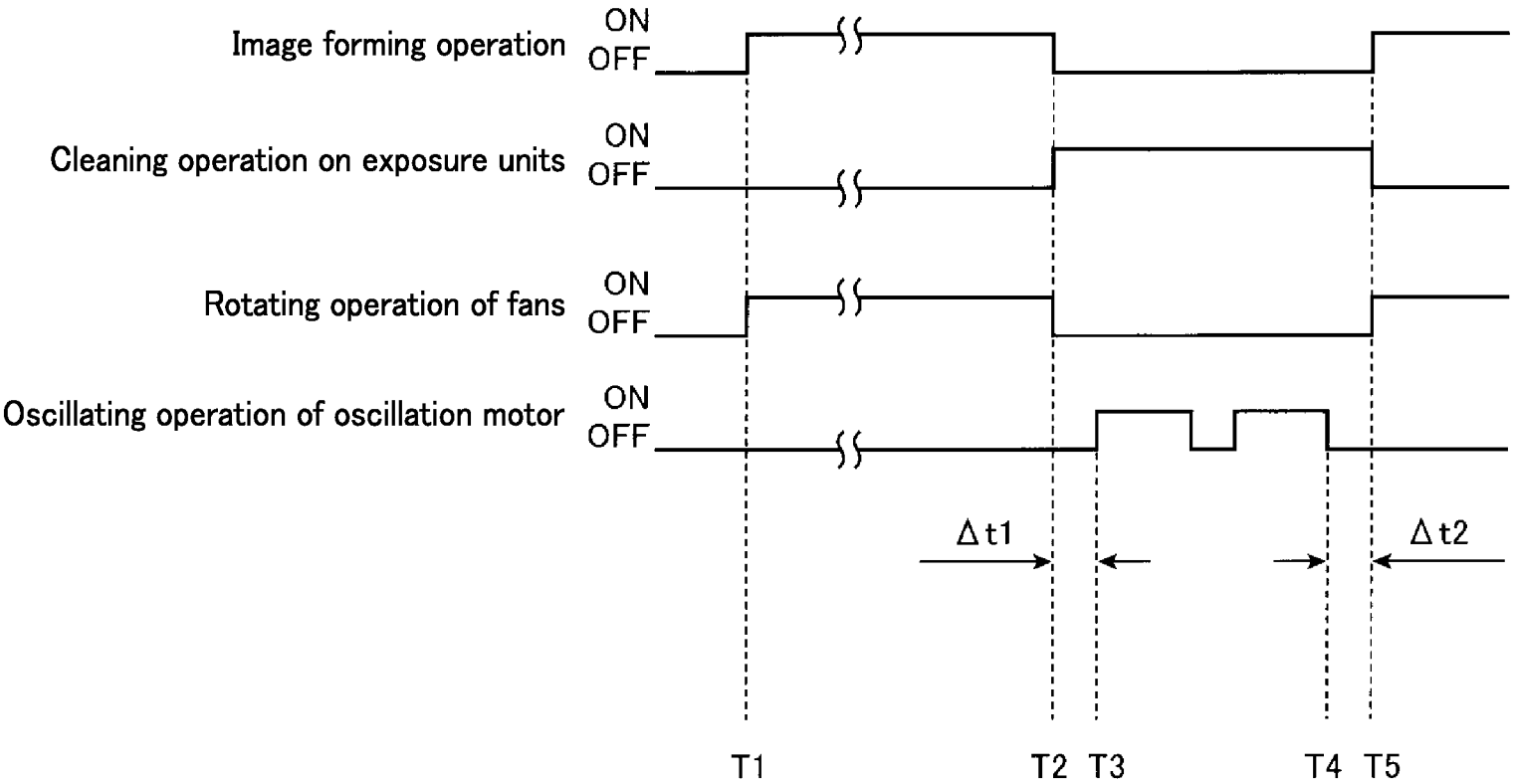
FIG. 9 is a timing chart depicting operation timing of an oscillation section in the image forming apparatus according to one embodiment of the present disclosure.

Suitable timing for oscillation of the first filter 811 by the oscillation motor 812 will be described next with reference to FIGS. 7-9. FIG. 7 is a block diagram showing electrical connection to the controller 95 in the image forming apparatus 1 according to the present embodiment. FIG. 8 is a schematic illustration of a cleaning section 90 of each exposure unit 323 in the image forming apparatus 1 according to the present embodiment. Further, FIG. 9 is a timing chart depicting operation timing of the oscillation motor 812 in the image forming apparatus 1 according to the present embodiment.

As shown in FIG. 7, the controller 95 includes a central processing unit (CPU), a read only memory (ROM) to store a control program, a random access memory (RAM) used as a working area of the CPU, etc. Further, to the controller 95, the image forming section 30 including the aforementioned developing devices 324, the first and second fans 83 and 84, and the oscillation motor 812 are connected electrically. Still more, the cleaning section 90 of each exposure unit 323 is electrically connected to the controller 95. The controller 95 functions as the drive controller 96 by allowing the CPU to execute the control program stored in the ROM.

The drive controller 96 controls the drive section (not shown) to dive the respective member of the image forming section 30, the first and second fans 83 and 84, and the oscillation motor 812 with the below mentioned timing. Further, the drive controller 96 drives and rotates a motor 91 of the cleaning section 90, which will be described later, to cause the cleaning section 90 to perform a cleaning operation.

As shown in FIG. 8, each exposure unit 323 includes a transparent glass 323A (transparent member) and the cleaning section 90.

The transparent glass 323A is a transparent plate member extending in the main scanning direction of the exposure unit 323. Exposure light is emitted from the transparent glass 323A toward the peripheral surface of the corresponding photosensitive drum 321.

The cleaning section 90 is in contact with the surface of the transparent glass 323A to clean the transparent glass 323A. Accordingly, the exposure light can be prevented from being blocked by toner or dust adhering to the surface of the transparent glass 323A. In particular, the cleaning section 90 cleans the transparent glass 323A in a non-image formation time when the image forming operation is not performed in the image forming section 30. The cleaning section 90 includes the motor 91, a screw shaft 92, and a cleaning member 93.

The motor 91 is connected to the screw shaft 92 to rotate the screw shaft 92 in the normal and reverse directions, as shown in FIG. 8.

The screw shaft 92 is connected to the motor 91. A male screw 92*a* is formed around the outer peripheral surface of the screw shaft 92. The screw shaft 92 extends in parallel to the transparent glass 323A.

The cleaning member 93 includes a cylindrical portion 93*a*, a contact portion 93*b*, and a connection portion 93*c*. The cylindrical portion 93*a* is a cylindrical member around the inner peripheral surface of which a female screw (not shown) for engagement with the male screw 92*a* of the screw shaft 92 is formed. The contact portion 93*b* moves while being in contact with the surface of the transparent glass 323A to wipe off extraneous matter adhering to the surface of the transparent glass 323A, such as toner. Of the contact portion 93*b*, at least a part in contact with the transparent glass 323A is made from a material having high ability to wipe off fine powder of toner and the like, for example, a sponge, a brush, non-woven fabric, etc. The connection portion 93*c* connects the cylindrical portion 93*a* and the contact portion 93*b* together.

When the motor 91 rotates the screw shaft 92 in the normal or reverse direction, the cylindrical portion 93*a* in engagement with the screw shaft 92 receives a linear drive force from the screw shaft 92. This moves the cleaning member 93 in the main scanning direction along the surface of the transparent glass 323A. At this time, the contact portion 93*b* moves extraneous matter, such as toner adhering to the surface of the transparent glass 323A outside the opposite ends of the transparent glass 323A in the longitudinal direction (main scanning direction). Thus, the extraneous matter can be removed from the transparent glass 323A. During the time when the cleaning operation is not performed, the cleaning member 93 waits at a retreat position outside the transparent glass 323A in the main scanning direction.

With reference to FIG. 9, the oscillation timing of the oscillation motor 812 according to the present embodiment will be described next. The operation timing is shown in timeline from left to right in FIG. 9. The operation timing is shown for an image forming operation in the image forming section 30, a cleaning operation by the cleaning sections 90 on the exposure units 323, each rotating operation of the first and second fans 83 and 84 of the toner collecting unit 8, and an oscillating operation of the oscillation motor 812 in this order from above. It is noted that an image formation time corresponds to a period from time T1 to T2 and a period of time T5 and thereafter. The non-image formation time corresponds to a period from time T2 to time T5.

When the controller 95 causes the image forming section 30 to start performing the image forming operation (time T1) in association with the use of the image forming apparatus 1, the drive controller 96 starts driving the respective members of the image forming section 30. Simultaneously, in the image formation time, the drive controller 96 causes the first and second fans 83 and 84 of the toner collecting unit 8 to rotate. It is noted that the drive controller 96 outputs a rotation start signal and a rotation stop signal for the first and second fans 83 and 84 to control each rotation of the first and second fans 83 and 84. In the image forming operation of the image forming section 30, the development rollers 101 (101Y-101Bk in FIG. 4) of the developing devices 324 and the screws (not shown) are rotated. At this time, toner (flying toner), which is less charged in each developing device 324, stirs up in the interior of the developing device 324. When such less charged toner is supplied to any development roller 101, a defect in image quality may be liable to be caused in a toner image corresponding to an electrostatic latent image on the corresponding photosensitive drum 321. In the present embodiment, the first and second fans 83 and 84 are rotated in the image formation time, as described above. Accordingly, the flying toner can be collected in the toner collecting unit 8 from the developing devices 324 for the respective colors through the collection duct 7. In particular, the first filter section 81 arranged on the most upstream side in the housing 80 of the toner collecting unit 8 can favorably catch the flying toner.

By contrast, when the image forming operation of the image forming section 30 terminates (time T2), the drive controller 96 stops driving each member of the image forming section 30. At the same time, the drive controller 96 outputs the rotation stop signal to each of the first and second fans 83 and 84 to stop each rotation of the first and second fans 83 and 84. Moreover, the drive controller 96 controls the cleaning sections 90 of the exposure units 323 to allow them to start the cleaning operation on the transparent glasses 323A. Thus, since each transparent glass 323A is cleaned in the non-image formation time when the image forming operation is not performed in the image forming section 30, stable toner image formation can be achieved in the next image forming operation (time T5 and thereafter).

Moreover, the drive controller 96 controls the oscillation motor 812 to oscillate the first filter 811 of the first filter section 81 in the non-image formation time, in other words, in the cleaning operation by the cleaning sections 90 on the transparent glasses 323A.

Specifically, the drive controller 96 outputs the rotation stop signal for the first and second fans 83 and 84 at time T2, and controls then the oscillation motor 812 to oscillate the first filter 811 (time T3) after a predetermined time period (Δt1) elapses. Thus, even when the first and second fans 83 and 84 rotates by inertia after output of the rotation stop signal for the first and second fans 83 and 84, oscillation can prevent adhesion of toner falling from the first filter 811 to the first filter 811 again, which may be caused by air suction by the first and second fans 83 and 84, as far as possible. It is noted that Δt1 is set to be 1 second or longer in the present embodiment. Accordingly, the toner can be stably prevented from adhering again to the first filter 811.

Yet further, as shown in FIG. 9, the drive controller 96 controls oscillation start and stop of the first filter 811 by the oscillation motor 812 twice (plural times) in succession in the non-image formation time. Accordingly, shock at oscillation start of the first filter 811 by the oscillation motor 812 is caused plural times. Accordingly, effective falling of the toner from the first filter 811 can be caused. It is noted that oscillation start and stop of the first filter 811 may be performed three or more times in succession.

Yet further, the drive controller 96 stops the oscillation motor 812 at time T4. In other words, the drive controller 96 stops oscillation of the first filter 811 by the oscillation motor 812 (time T4) a predetermined time period (Δt2) before the time T5 when the drive controller 96 outputs the rotation start signal for the first and second fans 83 and 84 for the next image forming operation. This can prevent as far as possible rotation start of the first and second fans 83 and 84 in the state where toner falling from the first filter 811 by oscillation flies in the air in the lower duct 803 (FIG. 5). It is noted that Δt2 is set to be 1 second or longer in the present embodiment. Accordingly, rotation start of the first and second fans 83 and 84 in the state where the toner flies can be further stably prevented.

Thus, in the present embodiment, the drive controller 96 causes the first and second fans 83 and 84 to rotate in the image formation time to collect unnecessary toner from the image forming section 30. By contrast, the drive controller 96 controls the oscillation motor 812 to oscillate the first filter 811 in the non-image formation time of the image forming section 30. Accordingly, toner falling from the first filter 811 can be prevented from adhering again to the first filter 811, which may be caused by air suction by the first and second fans 83 and 84, as far as possible. Moreover, the first filter 811 is oscillated in cleaning the transparent glasses 323A by the cleaning sections 90. Accordingly, the cleaning operation on the transparent glasses 323A and the cleaning operation on the first filter 811 can be performed in parallel in the image forming apparatus 1, thereby shortening the period of the non-image formation time.

Figure 10:
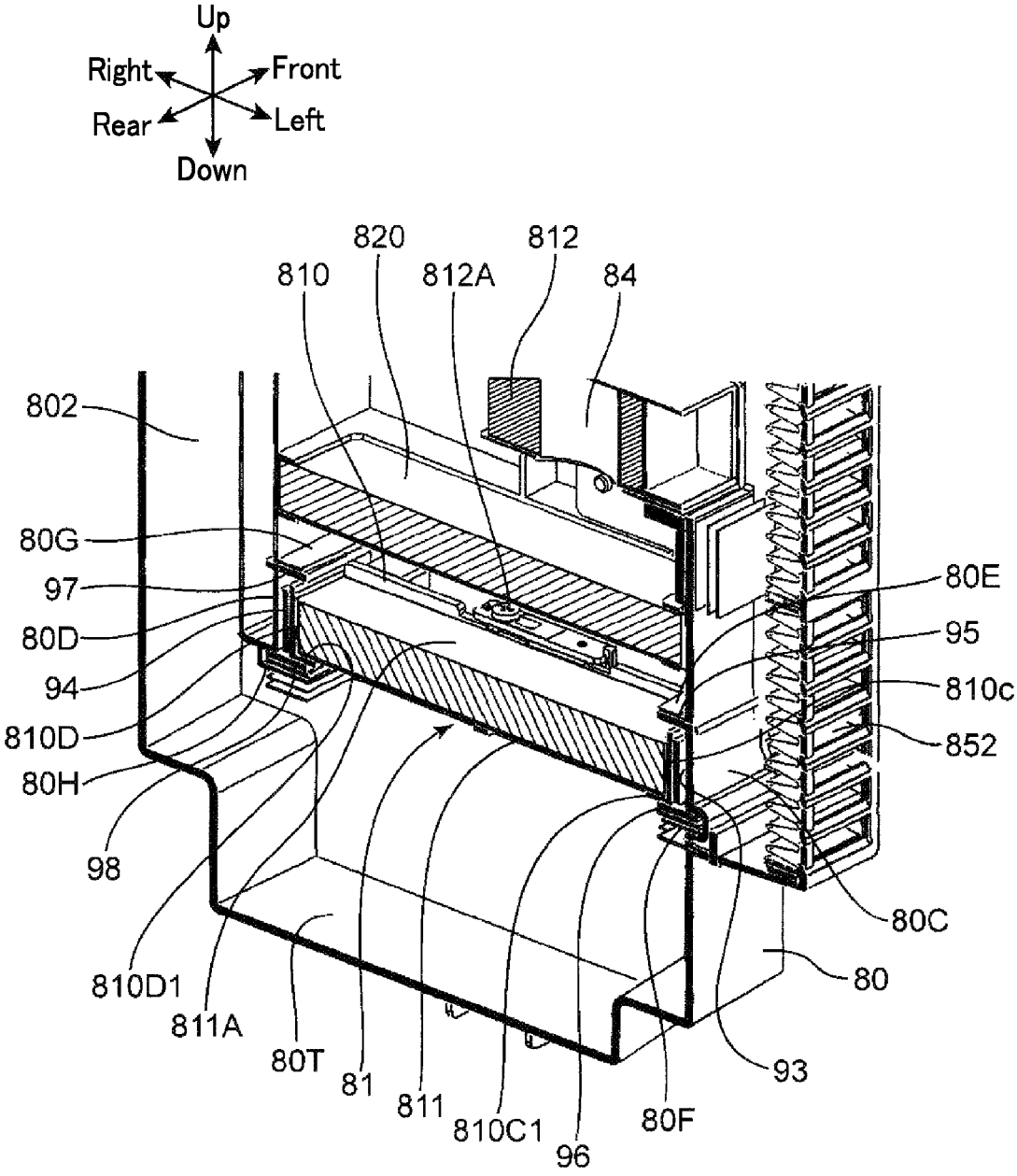
FIG. 10 is a cross sectional perspective view of the interior of the toner collecting unit according to one embodiment of the present disclosure.
Figure 11:
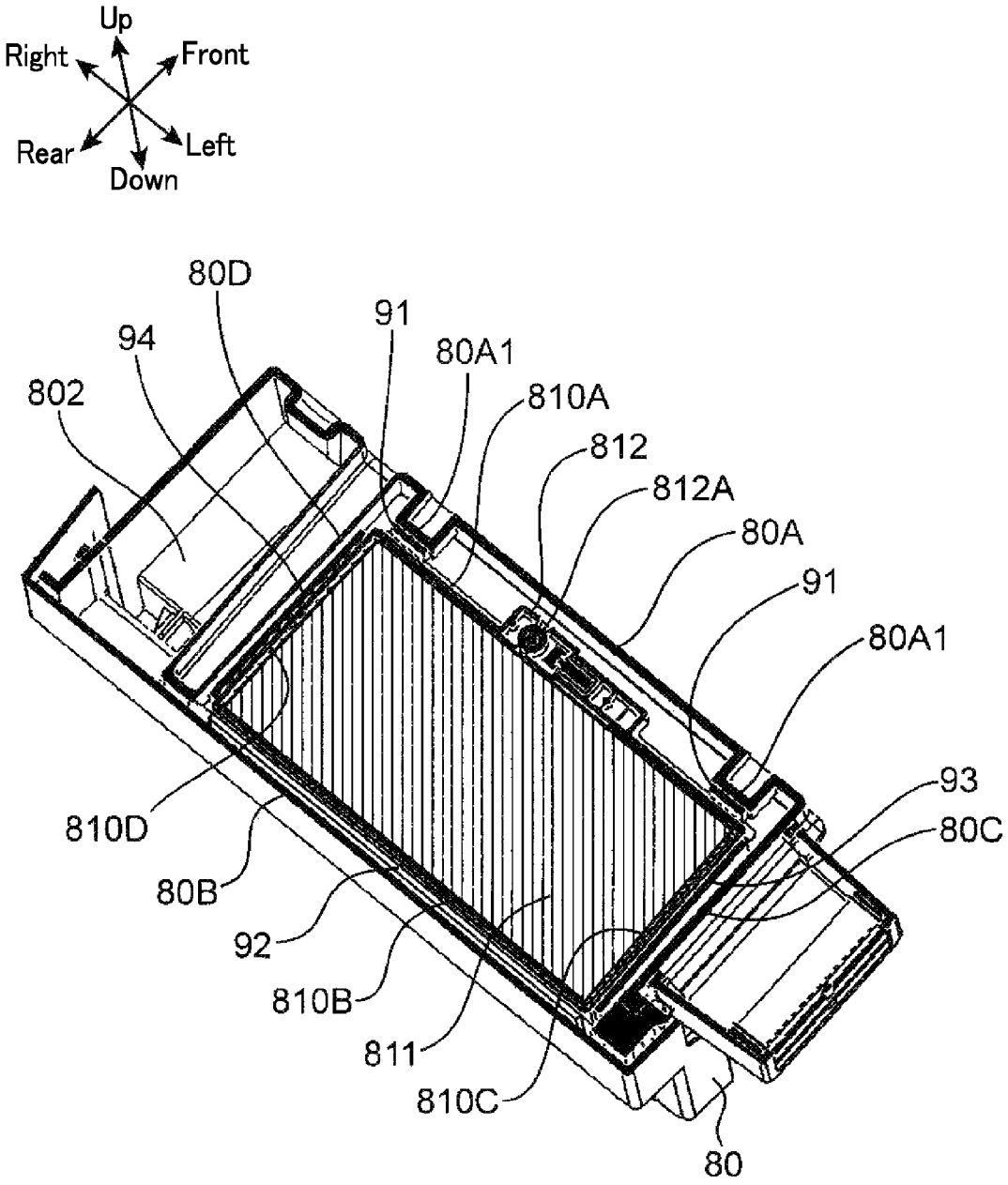
FIG. 11 is a cross sectional perspective view of the interior of the toner collecting unit according to one embodiment of the present disclosure.

FIGS. 10 and 11 are referred herein. FIGS. 10 and 11 are cross sectional perspective view of the interior of the toner collecting unit 8. The toner collecting unit 8 collects unnecessary toner from the image forming section 30. In the present embodiment, as described above, flying toner is collected as the unnecessary toner from the developing devices 324. The housing 80 includes eight (six types of) support walls arranged to face the respective six surfaces of the first filter 811. Specifically, the housing 80 includes a front wall 80A (first support wall), a rear wall 80B (second support wall), a left wall 80C (third support wall), and a right inner wall 80D (fourth support wall). The housing 80 further includes an upper left rib 80E (fifth support wall), a lower left rib 80F (sixth support wall), an upper right rib 80G (fifth support wall), and a lower right rib 80H (sixth support wall).

The front wall 80A is arranged to face the front side surface of the first filter 811. The front frame portion 810A of the frame 810 is arranged between the front side surface of the first filter 811 and the front wall 80A. The front wall 80A includes a pair of protruding walls 80A1. The protruding walls 80A1 are formed in a fashion that the right and left end parts of the front wall 80A partially protrude toward the front frame portion 810A. The rear wall 80B is arranged to face the rear side surface of the first filter 811. The rear frame portion 810B of the frame 810 is arranged between the rear side surface of the first filter 811 and the rear wall 810B. Similarly, the left wall 80C is arranged to face the left side surface of the first filter 811. The left frame portion 810C of the frame 810 is arranged between the left side surface of the first filter 811 and the left wall 80C. The right inner wall 80D is arranged to face the right side surface of the first filter 811. The right frame portion 810D of the frame 810 is arranged between the right side surface of the first filter 811 and the right inner wall 80D. The aforementioned descending duct portion 802 is arranged on the right side of the right inner wall 80D.

The upper left rib 80E is arranged to face the exhaust surface 811A of the first filter 811 above the left frame portion 810C. In other words, the upper left rib 80E is arranged to face the upper edge of the left frame portion 810C. The upper left rib 80E is a rib member protruding rightward from the left wall 80C. The lower left rib 80F is arranged to face the approach surface (not shown) of the first filter 811 below the left frame portion 810C. In other words, the lower left rib 80F is arranged to face a left bent portion 810C1 which is a rightwardly bent lower end part of the left frame portion 810C. The left bent portion 810C1 can prevent the first filter 811 from falling down from the frame 810. The lower left rib 80F is a rib member protruding rightward from the left wall 80C.

Similarly, the upper right rib 80G is arranged to face the exhaust surface 811A of the first filter 811 above the right frame portion 810D. In other words, the upper right rib 80G is arranged to face the upper edge of the right frame portion 810D. The upper right rib 80G is a rib member protruding leftward from the right inner wall 80D. The lower right rib 80H is arranged to face the approach surface (not shown) of the first filter 811 below the right frame portion 810D. In other words, a lower right rib 80H is arranged to face a right bent portion 810D1 which is a lefwardly bent lower edge of the right frame portion 810D. The right bent portion 810D1 also can prevent the first filter 811 from falling down from the frame 810. The lower right rib 80H is a rib member protruding leftward from the right inner wall 80D.

Moreover, the toner collecting unit 8 includes front sponges 91, a rear sponge 92, a left sponge 93, a right sponge 94, an upper left sponge 95, a lower left sponge 96, an upper right sponge 97, and a lower right sponge 98 (each being an elastic member). The sponges are compressed between the frame 810 and the housing 80 to prevent transmission of oscillation from the frame 810 to the housing 80. As shown in FIGS. 10 and 11, the front sponges 91 are arranged in pair between the front frame portion 810A and the pair of protruding walls 80A1. Further, the rear sponge 92 is arranged between the rear frame portion 810B and the rear wall 80B. The left sponge 93 is arranged between the left frame portion 810C and the left wall 80C. The right sponge 94 is arranged between the right frame portion 810D and the right wall 80D.

Furthermore, the upper left sponge 95 is arranged between the upper edge of the left frame portion 810C and the upper left rib 80E. The lower left sponge 96 is arranged between the left bent portion 810C1 of the left frame portion 810C and the lower left rib 80F. The upper right sponge 97 is arranged between the upper edge of the right frame portion 810D and the upper right rib 80G. The lower right sponge 98 is arranged between the right bent portion 810D1 of the right frame portion 810D and the lower right rib 80H. It is noted that the upper left sponge 95 and the upper right sponge 97 may be in contact with the edge 810A2 of the front frame portion 810A. The above sponges are arranged in this fashion between the respective six support walls arranged to face the respective six surfaces of the first filter 811 and the frame 810 in the present embodiment.

Thus, the sponges are arranged between the frame 810 and the housing 80 in the present embodiment. This can prevent oscillation of the first filter 811 by the oscillation unit 812 from being transmitted to the housing 80. Accordingly, oscillation noise by oscillation of the housing 80 can be prevented from being caused. Specifically, the front sponges 91, the rear sponge 92, the left sponge 93, the right sponge 94, the upper left sponge 95, the lower left sponge 96, the upper right sponge 97, and the lower right sponge 98 can prevent transmission of oscillation from the respective six surfaces of the first filter 811 to the housing 80. In other words, transmission of oscillation in the vertical direction, the back-and-forth directions, and the right and left directions can be reduced. This can reliably reduce oscillation noise by oscillation of the housing 80. Further, the oscillation unit 812 is mounted directly on the frame 810 rather than the housing 80, which can further reduce transmission of oscillation.

The toner collecting unit 8 and the image forming apparatus 1 including it according to the present embodiment have been described so far. However, the present disclosure is not limited to them and can be modified to any of the following variations, for example.

(1) The present disclosure is not limited to the above embodiment, in which the relationship, $A2 \geq A1 \geq A3$ is satisfied where A1, A2, and A3 are a flow rate of the air flow in the first filter 811 of the first filter section 81, a flow rate thereof in the second filter 820 of the second filter section 82, and each flow rate thereof in the upper and lower exhaust filters 851 and 852, respectively. It is possible that the relationship, $S3 \geq S2 \geq S1$ is satisfied where S1, S2, and S3 are a sectional area of a section of the first filter 811 taken in the direction of the air flow, a sectional area thereof of the second filter 820 taken therein, and each sectional area thereof of the upper and lower exhaust filters 851 and 852 taken therein, respectively. Alternatively, the relationship, $L3 \geq L2 \geq L1$ may be satisfied where L1, L2, and L3 are a thickness of the first filter 811 in the direction of the air flow, a thickness of the second filter 820 therein, and each thickness of the upper and lower exhaust filters 851 and 852 therein, respectively. Or, the relationship, $N3 \geq N2 \geq N1$ may be satisfied where N1, N2, and N3 are a density of the first filter 811, a density of the second filter 820, and each density of the upper and lower exhaust filters 851 and 852, respectively. Even in the case where any of the relationships is satisfied, the air flow toward the first and second fans 83 and 84 can be formed reliably. Also, the toner can be favorably caught in the first filter 811 and the second filters 820 on the upstream side. Still more, the upper and lower exhaust filters 851 and 852 arranged on the most downstream side in the path of the air flow can reliably trap toner that cannot have been caught by the first and second filters 811 and 820.

(2) Further, the present disclosure is not limited to the above embodiment, in which the oscillation motor 812 is driven in correspondence with the cleaning operation by the cleaning sections 90 on the transparent glasses 323A. The oscillation motor 812 may be solely driven in the non-image formation time when the image forming operation is not performed in the image forming section 30. Still further, each sucking operation of the first and second fans 83 and 84 is not necessarily performed in the image formation time only. The first and second fans 83 and 84 may be rotated also in the non-image formation time. In this case, it is preferable to drive the oscillation motor 812 when the first and second fans 83 and 84 are not rotated. Even in this case, falling toner can be prevented from adhering again to the first filter 811 in oscillation of the first filter 811 under control by the oscillation motor 812.

(3) The present disclosure is not limited to the above embodiment, in which the housing 80 includes the six support walls facing the six surfaces of the first filter 811, and the sponges are arranged between the six support walls and the frame 810. It is possible that support walls may be provided to face one and another surface of the six surface of the first filter 811, and predetermined elastic members may be arranged between the frame 810 and the support walls. In other words, only required is to arrange the elastic members to press two or more surfaces of the six surfaces of the first filter 811. Further, the elastic members are not limited to the sponges and may be made from rubber. Alternatively, the elastic members may be coil springs or plate springs. It is noted that the two surfaces may preferably intersect with each other. Even in this case, oscillation of the first filter 811 by the oscillation unit 812 can be favorably prevented from being transmitted to the housing 80. This can especially reduce oscillation in at least two directions of the vertical direction, the back-and-forth directions, and the right and left directions, thereby favorably reducing oscillation noise by the oscillation of the housing 80.

(4) Yet further, the present disclosure is not limited to the above embodiment, in which the air flow is exhausted in the horizontal direction from the exhausting section 85. The air flow may be exhausted from the exhausting section 85 in another direction. Still further, the number of fans, as the first and second fans 83 and 84, is not limited to two. However, provision of a plurality of fans can form a larger air flow in the interior of the housing 80.

(5) In addition, the present disclosure is not limited to the above embodiment, in which the oscillation motor 812 is used as an oscillation section to oscillate the first filter 811. A cam member or a solenoid in direct contact with the first filter 811 or the frame 810 may be employed as the oscillation section.

What is claimed is:

1. A toner collecting device, comprising:

a housing;

an inlet which is provided in the housing and into which toner flows together with an air flow;

a fan arranged in an interior of the housing and configured to suck the air flow flowing from the inlet and to exhaust the air flow outside the housing;

a guide duct portion arranged between the inlet and the fan in a path of the air flow and is configured to guide the air flow upward from below;

a first filter arranged upstream of the fan in the path of the air flow and in an upper part of the guide duct portion so that its approach surface, which the air flow enters, faces downward;

an oscillation section configured to oscillate the first filter;

a second filter arranged between the fan and the first filter in the path of the air flow and configured to catch the toner and to allow the air flow to pass therethrough; and a third filter arranged downstream of the fan in the path of the air flow and configured to allow the air flow to pass therethrough;

wherein a relationship, $A2 \geq A1 \geq A3$ is satisfied where A1 is a flow rate of the air flow in the first filter, A2 is a flow rate thereof in the second filter, and A3 is a flow rate thereof in the third filter.

2. A toner collecting device according to claim 1, further comprising:

an introduction portion configured to allow the air flow flowing from the inlet to flow into the guide duct portion from a side of the guide duct portion; and a reservoir arranged at the guide duct portion at a lower level than the introduction portion and configured to retain toner falling from the first filter by oscillation of the oscillation section.

3. A toner collecting device according to claim 1, wherein a relationship, $S3 \geq S2 \geq S1$ is satisfied where S1 is a sectional area of a section of the first filter in a direction of the air flow, S2 is a sectional area of a section of the second filter in the direction of the air flow, and S3 is a sectional area of a section of the third filter in the direction of the air low.

4. A toner collecting device according to claim 1, wherein a relationship, $L3 \geq L2 \geq L1$ is satisfied where L1 is a thickness of the first filter in the direction of the air flow, L2 is a thickness of the second filter in the direction of the air flow, and L3 is a thickness of the third filter in the direction of the air flow.

5. A toner collecting device according to claim 1, wherein a relationship, $N3 \geq N2 \geq N1$ is satisfied where N1 is a density of the first filter, N2 is a density of the second filter, and N3 is a density of the third filter.

6. A toner collecting device according to claim 1, further comprising:

a frame supported to the housing and configured to hold the first filter.

7. An image forming apparatus, comprising:

an image bearing member configured to bear a toner image;

a developing device configured to supply toner to the image bearing member;

a toner collecting device according to claim 1; and a collection duct configured to collect the toner together with an air flow in an interior of or around the developing device and to allow the toner to flow into the inlet.

8. An image forming apparatus according to claim 7, further comprising:

an image forming section configured to perform an image forming operation to form a toner image on a sheet; and a drive controller, wherein the drive controller causes the fan to rotate in an image formation time when the image forming operation is performed and controls the oscillation section to oscillate the first filter in a non-image formation time when the image forming operation is not performed.

9. An image forming apparatus according to claim 8, wherein the image forming section includes the image bearing member having a peripheral surface on which an electrostatic latent image is formed and an exposure device configured to expose the peripheral surface of the image bearing member to form the electrostatic latent image, the exposure device includes: a transparent member from which exposure light is emitted; and a cleaning section which is in contact with a surface of the transparent member in the non-image formation time to clean the transparent member, and the drive controller causes the first filter to oscillate in correspondence with a cleaning operation by the cleaning section on the transparent member.

10. An image forming apparatus according to claim 8, wherein the drive controller outputs a rotation start signal and a rotation stop signal for the fan to control rotation of the fan and causes the first filter to oscillate when a predetermined time period elapses after output of the rotation stop signal for the fan.

11. An image forming apparatus according to claim 10, wherein the drive controller causes the first filter to oscillate when a period of 1 second or longer elapses after output of the rotation stop signal for the fan.

12. An image forming apparatus according to claim 8, wherein the drive controller outputs a rotation start signal and a rotation stop signal for the fan to control rotation of the fan, and stops oscillation of the first filter a predetermined time period before output of the rotation start signal for the fan.

13. A toner collecting device, comprising:

a housing;

an inlet which is provided in the housing and into which toner flows together with an air flow;

a fan arranged in an interior of the housing and configured to suck the air flow flowing from the inlet and to exhaust the air flow outside the housing;

a guide duct portion arranged between the inlet and the fan in a path of the air flow and is configured to guide the air flow upward from below;

a filter arranged upstream of the fan in the path of the air flow and in an upper part of the guide duct portion so that its approach surface, which the air flow enters, faces downward;

an oscillation section configured to oscillate the filter;

a frame supported to the housing and configured to hold the filter; and an elastic member arranged between the frame and the housing.

14. A toner collecting device according to claim 13, wherein the filter is in a rectangular parallelepiped shape having six surfaces as peripheral surfaces including an approach surface which the air flow enters and an exhaust surface on an opposite side to the approach surface from which the air flow is exhausted, the frame includes a wall portion which includes an edge parallel to the approach surface and the exhaust surface, and which covers four surfaces of the six surfaces which intersects with the approach surface, the housing includes a first support wall arranged to face one surface of the six surfaces of the filter and a second support wall arranged to face another surface of the six surfaces of the first filter which is different from the one surface, and the elastic member is arranged between the frame and each of the first and second support walls.

15. A toner collecting device according to claim 14, wherein the housing includes six support walls including the first support wall and the second support wall, the six support walls being arranged to face the respective six surfaces of the filter, and the elastic member is arranged between each of the six support walls and the frame.

16. A toner collecting device according to claim 14, wherein the oscillation section is arranged on the edge of the frame.

17. A toner collecting device according to claim 13, wherein the elastic member is made from sponge or rubber.

18. A toner collecting device according to claim 13, wherein the elastic member is a coil spring or a plate spring.

* * * * *